US009155683B2

(12) United States Patent
Murrieta

(10) Patent No.: US 9,155,683 B2
(45) **Date of Patent: *Oct. 13, 2015**

(54) MEDICAL PATIENT ORAL HYDRATION SYSTEM

(71) Applicant: Eugene Murrieta, Incline Village, NV (US)

(72) Inventor: Eugene Murrieta, Incline Village, NV (US)

( * ) Notice: Subject to any disclaimer, the term of this patent is extended or adjusted under 35 U.S.C. 154(b) by 409 days.

This patent is subject to a terminal disclaimer.

(21) Appl. No.: 13/710,410

(22) Filed: Dec. 10, 2012

(65) Prior Publication Data

US 2013/0161350 A1 Jun. 27, 2013

Related U.S. Application Data

(63) Continuation-in-part of application No. 12/762,151, filed on Apr. 16, 2010, now Pat. No. 8,328,049.

(60) Provisional application No. 61/175,673, filed on May 5, 2009.

(51) Int. Cl.

| | |
|---|---|
| ***A61J 9/00*** | (2006.01) |
| ***A61J 7/00*** | (2006.01) |
| ***A61J 15/00*** | (2006.01) |
| *A61G 7/05* | (2006.01) |
| *A61J 9/06* | (2006.01) |
| *A45F 3/20* | (2006.01) |
| *A45F 3/16* | (2006.01) |

(52) U.S. Cl.

CPC ..... *A61J 9/006* (2013.01); *A61J 7/0053* (2013.01); *A61J 15/0011* (2013.01); *A45F 3/20* (2013.01); *A45F 2003/166* (2013.01); *A61G 7/0503* (2013.01); *A61G 7/0507* (2013.01); *A61J 1/1418* (2015.05); *A61J 9/005* (2013.01); *A61J 9/0661* (2015.05); *A61J 15/0092* (2013.01); *A61J 2009/0661* (2013.01); *A61J 2200/76* (2013.01)

(58) Field of Classification Search

CPC ..... A61J 7/0053; A61J 9/005; A61J 9/006; A61J 15/0011; A61J 15/0092; A61J 2009/0661; A61J 2200/76; A61G 7/0503; A61G 7/0507; A45F 3/20; A45F 2003/166

See application file for complete search history.

(56) References Cited

U.S. PATENT DOCUMENTS

| | | | | | |
|---|---|---|---|---|---|
| 3,653,624 | A * | 4/1972 | Abel | 248/312 |
| 4,141,524 | A * | 2/1979 | Corvese, Jr. | 248/70 |
| 4,529,102 | A * | 7/1985 | Quinn et al. | 222/94 |
| 4,679,551 | A * | 7/1987 | Anthony | 601/160 |
| 4,699,319 | A * | 10/1987 | Green | 239/33 |
| 4,848,622 | A * | 7/1989 | Kroetsch | 220/705 |
| 5,040,756 | A * | 8/1991 | Via Cava | 248/103 |
| 5,085,349 | A * | 2/1992 | Fawcett | 220/703 |
| 5,484,405 | A * | 1/1996 | Edstrom, Sr. | 604/77 |
| 5,645,404 | A * | 7/1997 | Zelenak | 417/1 |
| 5,971,357 | A * | 10/1999 | Denton et al. | 251/144 |
| 7,207,968 | B1 * | 4/2007 | Harcinske | 604/77 |
| 2004/0045980 | A1 * | 3/2004 | Robins | 222/63 |

* cited by examiner

*Primary Examiner* — Nicholas J Weiss

(74) *Attorney, Agent, or Firm* — Leech Tishman Fuscaldo & Lampl; Kenneth D'Alessandro, Esq.

(57) ABSTRACT

An oral hydration system includes a mounting fitting configured to be mounted to a mounting structure and a holster rotatably coupled to the mounting fitting. A hydration liquid bladder is removably disposed in the holster. A feed tube has a proximal end communicating with the hydration liquid bladder. A backflow-prevention bite valve is coupled to a distal end of the feed tube.

9 Claims, 6 Drawing Sheets

MEDICAL PATIENT ORAL HYDRATION SYSTEM

CLAIM FOR PRIORITY

This application is a continuation-in-part of U.S. patent application Ser. No. 12/762,151, filed Apr. 16, 2010, which claims the benefit of U.S. Provisional Patent Application Ser. No. 61/175,673, filed on May 5, 2009, the entire disclosures of which are incorporated by reference herein.

BACKGROUND

Field of the Invention

The present invention relates to oral hydration systems for medical patients. More particularly, the present invention relates to an oral hydration system including a hydration water bladder with a holster and semi rigid boom, a feed tube terminated in a backflow-prevention bite valve.

Assuring that patients are sufficiently hydrated is a necessary part of medical care. Many patients have limited or no use of their arms, and are thus unable to hold a cup and/or a straw from which to drink. These patients must rely on another person to hold the cup for them. There is a significant danger that such patients may become dehydrated. Some patients can also tend to spill the water or other liquid in the bed, necessitating changing of the bed linens.

BRIEF DESCRIPTION

According to a first aspect of the presently claimed invention, an oral hydration system includes a hydration water bladder. The bladder includes a feed tube terminated in a backflow-prevention bite valve. The feed tube may be mounted in a semi-rigid conduit for a portion of its length. The bladder is mounted in a holster that may be affixed to the patient's bed or to a separate stand. The bladder or the holster may be provided with a volume scale so that the patient's oral fluid intake can be monitored.

According to a second aspect of the presently claimed invention, an oral hydration system additionally includes a mounting fitting configured to be mounted to a mounting structure and a holster rotatably coupled to the mounting fitting. This aspect allows the holster to swivel in response to movement affected upon the mounting structure such that the holster remains in a vertical position with respect to the floor.

BRIEF DESCRIPTION OF THE DRAWING FIGURES

DETAILED DESCRIPTION

Those of ordinary skill in the art will realize that the following description of the present invention is illustrative only and not in any way limiting. Other embodiments of the invention will readily suggest themselves to such skilled persons.

Figure 1:
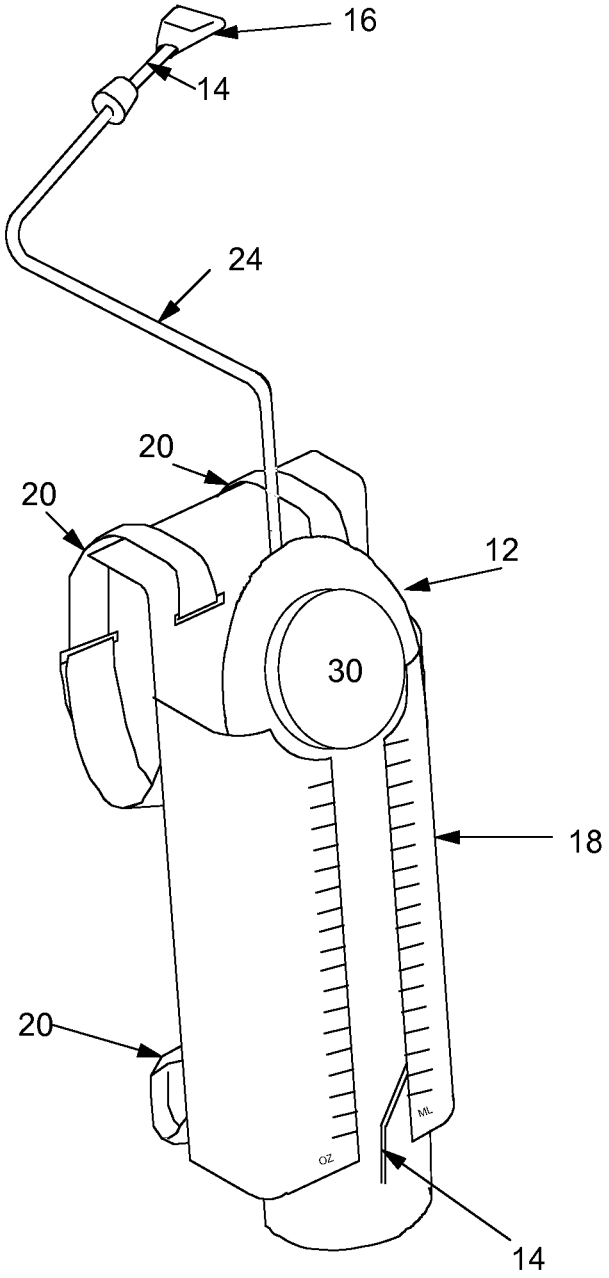
FIG. 1 is a diagram showing an illustrative patient hydration system in accordance with the present invention.
Figure 2:
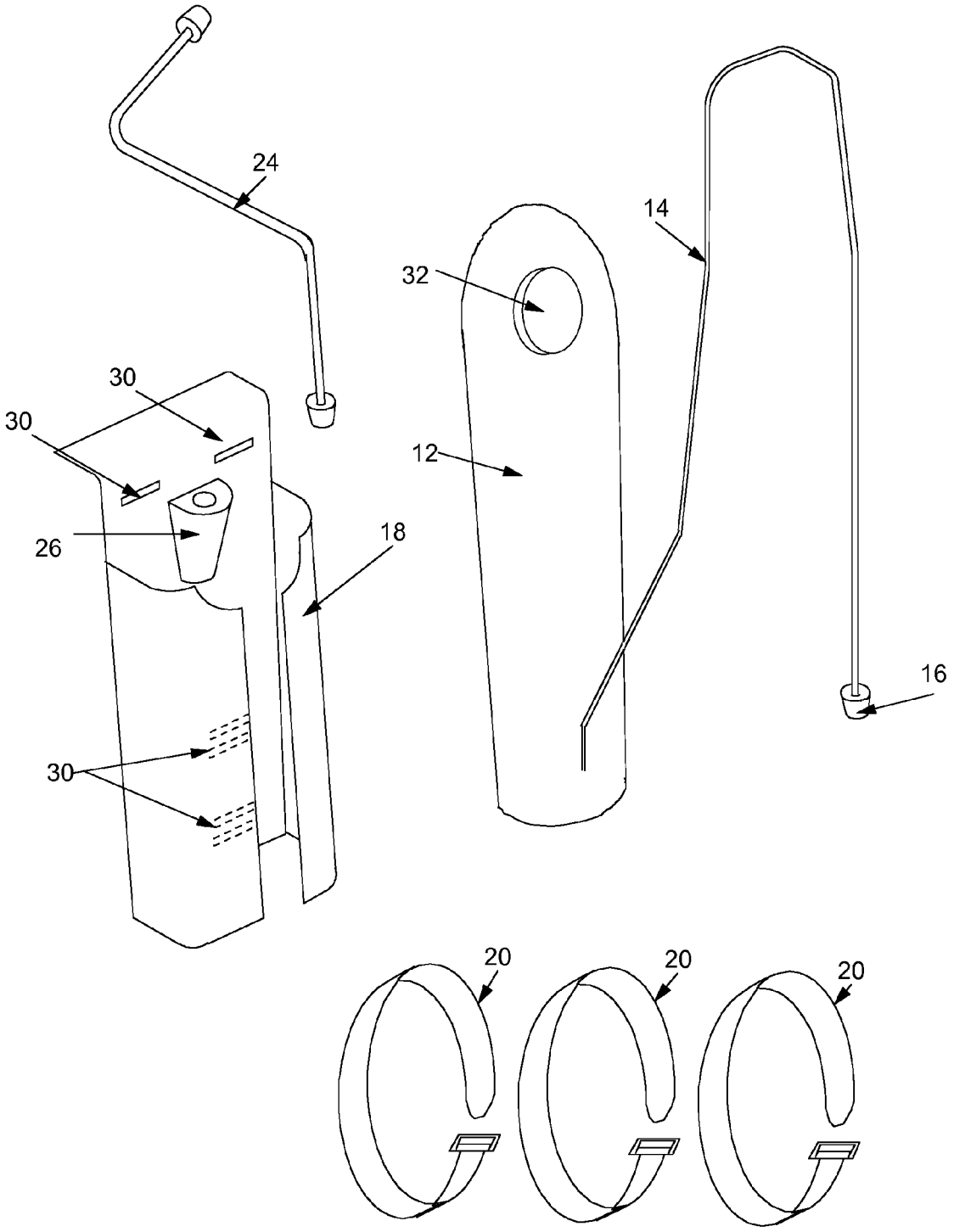
FIG. 2 is a diagram showing typical components of an illustrative patient hydration system in accordance with the present invention.

Referring first to FIGS. 1 and 2, diagrams show an illustrative patient hydration system in accordance with the present invention in an assembled an unassembled configuration, respectively. The patient hydration system 10 according to one aspect of the present invention includes a hydration bladder 12. Bladder 12 may be a commercially-available bladder available from a plurality of sources including Camelbak of Petaluma, Calif.

Hydration bladder 12 is coupled to a feed tube 14 terminating in a backflow-prevention bite valve 16. Feed tube 14 may be formed from medical grade plastic tubing. Bite valve 16 may be a valve such as one manufactured by Camelbak of Petaluma, Calif.

Bladder 12 is inserted into a hydration bladder holster 18, which may be formed or molded from a suitable material such as a plastic material. In use, the hydration bladder holster 18 containing the hydration bladder 12 may be attached to the side guardrails of a hospital bed or may be affixed to other structures such as an IV pole, a wheelchair or the like for convenience of the hospital staff. The exemplary embodiment of FIG. 1 shows holster 18 equipped with three hook-and-loop fastener straps 20. As discussed below, other embodiments may be configured to attach to the mounting structure using other attachment mechanisms known to persons of ordinary skill in the art.

FIG. 1 shows holster 18 provided with a volume scale so that the patient's oral fluid intake may be monitored. Persons of ordinary skill in the art will readily appreciate that the volume scale could alternatively be disposed on the bladder 12.

Figure 3:
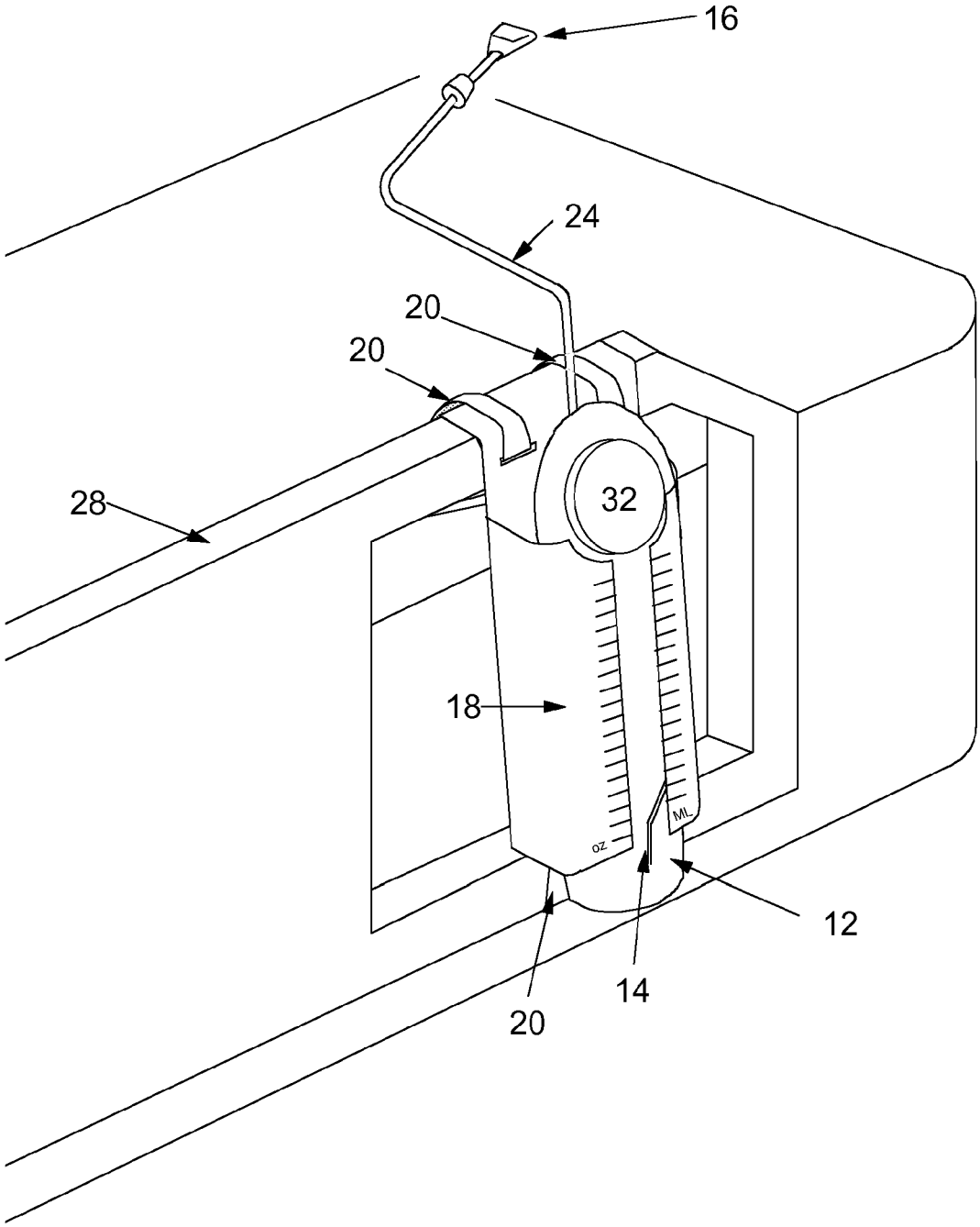
FIG. 3 is a diagram showing an illustrative patient hydration system affixed to a patient bed in accordance with the present invention.

Feed tube 14 may run through a semi-rigid boom (conduit) 24. The semi rigid boom 24 may be formed from a material such as metal or plastic and attaches to the holster 18 by means of threads, friction fit, or other fastening modality. By way of illustration, a mounting block 26 for mounting semi-rigid boom 24 is shown in FIG. 3. Semi-rigid boom 24 holds its position/shape, acting as a conduit for the feed tube 14. Semi-rigid boom 24 allows positioning the feed tube 14 to extend out over the bed so it may be positioned proximately to the patient's mouth.

Only the feed tube 14 and bite valve 16 directly contacts the fluid passing therethrough. The bite valve 16 closes when not being used, keeping the water or other liquid from flowing back into the bladder 12. To activate the bite valve 16, the patient squeezes it with his or her lips and sips water or other liquid as needed.

Referring now to FIG. 3, a diagram shows an illustrative patient hydration system affixed to a patient bed in accordance with the present invention. Bladder holster 18 is held to the side rails 28 of the hospital bed using hook-and-loop fastener straps 20 that mount through slots 30 in holster 18. Persons of ordinary skill in the art will appreciate that other fastening means may be used to affix holster 18 to the bedrails 28. Such skilled persons will also appreciate that holster 18 may be hung or attached from some other mounting structure, such as an IV pole (not shown). Bladder 12 includes filler cap 32 to allow filling the bladder 12 with a hydrating liquid such as water.

Figure 4:
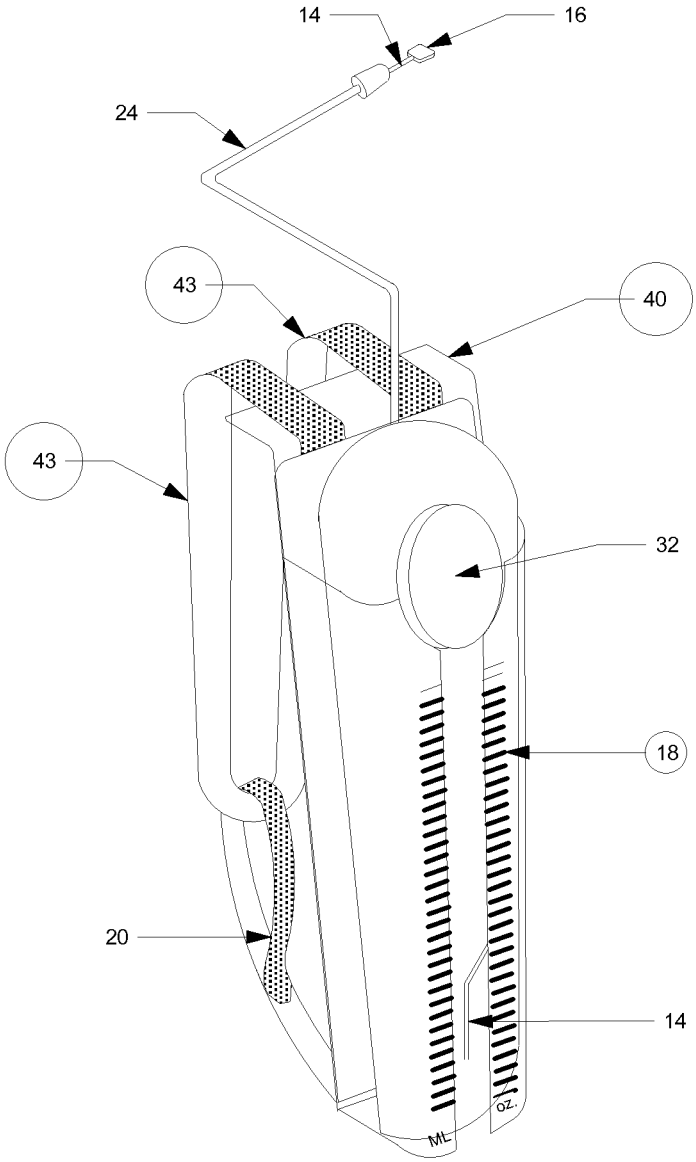
FIG. 4 is a diagram showing an additional illustrative patient hydration system in accordance with the present invention.
Figure 5:
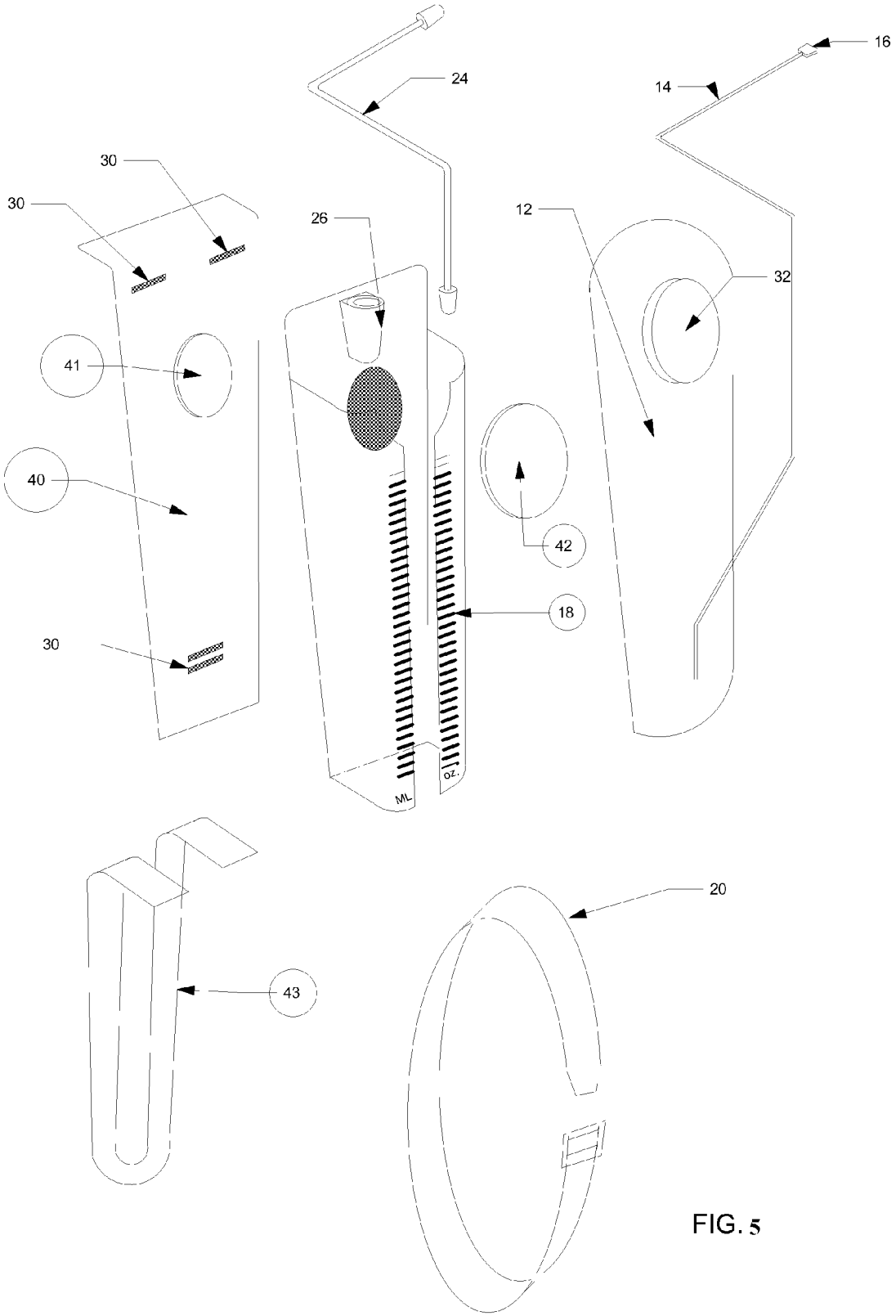
FIG. 5 is a diagram showing typical components of an additional illustrative patient hydration system in accordance with the present invention.

In another exemplary embodiment, patient hydration system 10 may also include a mounting fitting configured to be mounted to a mounting structure. The holster 18 may be rotatably coupled to the mounting fitting. As shown in FIGS. 4 and 5, in one illustrative embodiment, the mounting fitting may comprise a mounting plate 40, a rotatable member 41 attached to the mounting plate 40, and a retention plate 42. Rotatable member 41 may be attached to the mounting plate 40 and configured to mate with a corresponding aperture in the holster 18. The aperture in holster 18 may be placed over the rotatable member 41. Retention plate 42 may then be attached to the rotatable member 41 to rotatably couple the holster 18 to the mounting plate 40. In several other exemplary embodiments, the mounting fitting may include a mounting frame, a ball bearing assembly, or a non-rotatable peg configured to mate with an aperture in the holster 18 and attach to retention plate 42. Persons of ordinary skill in the art will readily recognize that many other types of mounting fittings may be used to allow the holster 18 to rotate in response to movement affected upon the mounting structure.

Figure 6:
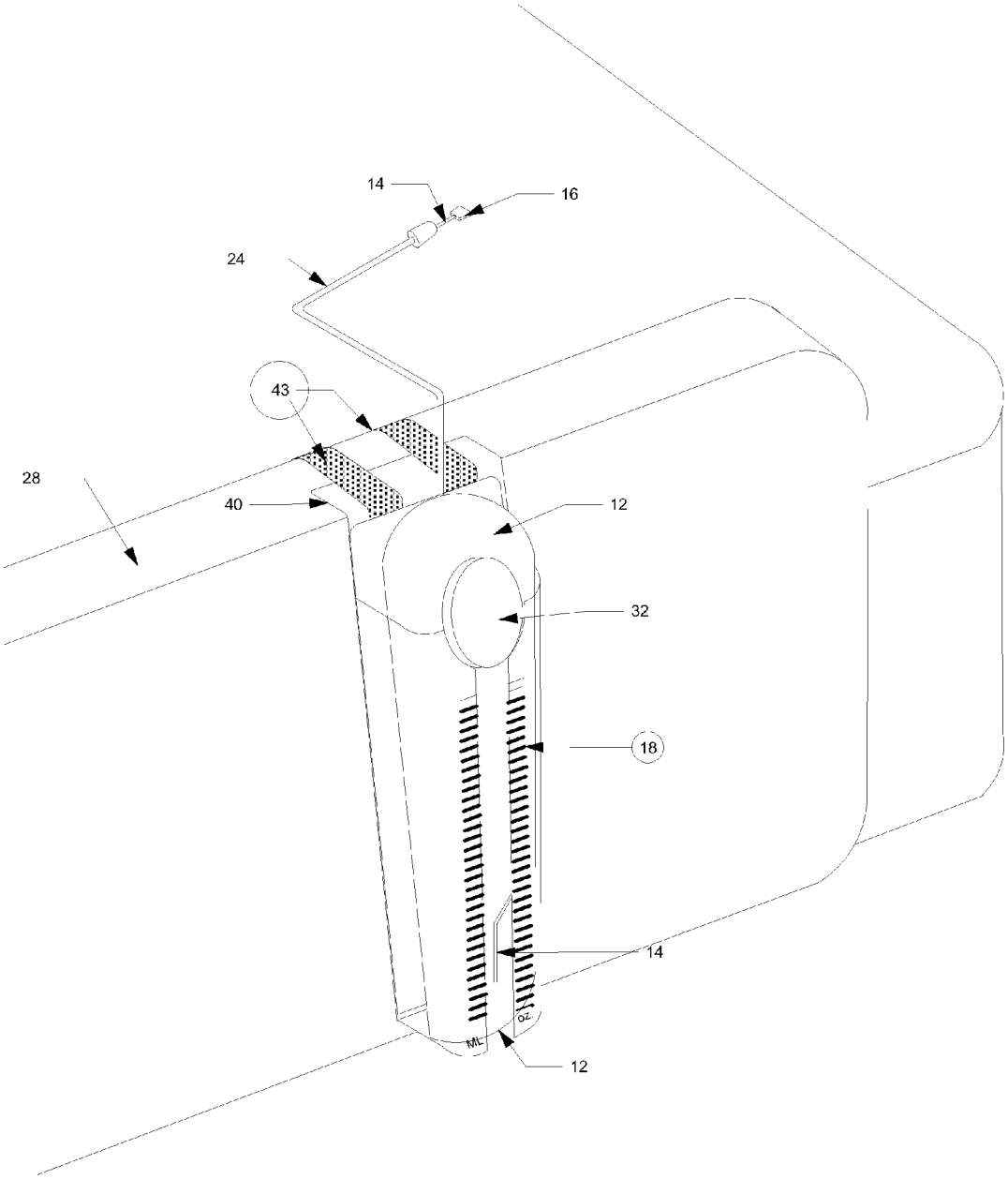
FIG. 6 is a diagram showing an additional illustrative patient hydration system affixed to a patient bed in accordance with the present invention.

The exemplary embodiment of FIG. 5 shows mounting plate 40 equipped with a single hook-and-loop fastener strap 20 and a flexible strap 43. When attached to a mounting structure through a mounting fitting as shown in FIG. 6, this exemplary embodiment allows the holster 18 to swivel in response to movement affected upon the mounting structure such that the holster 18 remains in a vertical position with respect to the floor. Persons of ordinary skill in the art will appreciate that other fastening means may be used to affix mounting plate 40, or other mounting fittings in other embodiments, to the bedrails 28. For example, rather than flexible strap 43, a clip may be used. Such persons will also appreciate that patient hydration system 10 may be attached to some other mounting structure, such as an IV pole (not shown).

In use, the holster 18 with hydration bladder 12 in it is attached, for example, to the side guardrail 28 of the hospital bed. The semi rigid boom 24 is attached to the holster 18. The bladder is then filled with water. The semi rigid boom 24 is positioned to extend out over to a position proximate to the patient's mouth. The patient can lean forward or bring the bite valve into his or her mouth and sip water or other liquid from the feed tube. If a patient raises the head of his or her hospital bed to an angled position while using the exemplary embodiment of FIGS. 4-6, the holster 18 reacts to gravity by swiveling to remain in a vertical position. Doing so reduces the chance that fluid may leak from the filler cap 32. Moreover, it also enhances the legibility of the fluid-volume scale by keeping it upright.

The oral hydration of medical patients according to the present invention without the use of an IV or cup and straw allows patient to squeeze the bite valve with his or her lips and sip water as needed. Proper hydration of patients encourages faster patient recovery. Using the present invention, the water or other liquid will not spill, thus saving time and labor for the changing of bed linens. This reduces staff time to administer water for hydration, eases the monitoring of patient oral liquid consumption over a given time.

While illustrative embodiments of the present invention have been shown, persons skilled in the art will realize that other embodiments employing the inventive principles disclosed herein are possible, and such embodiments will readily suggest themselves to such skilled persons. Thus the invention should only be limited within the spirit of the claims.

What is claimed is:

1. An oral hydration system including:

a mounting fitting configured to be mounted to a mounting structure;

a holster rotatably coupled to the mounting fitting;

a hydration liquid bladder removably disposed in the holster;

a feed tube having a proximal end communicating with the hydration liquid bladder;

a backflow-prevention bite valve coupled to a distal end of the feed tube; and a boom formed from a self-supporting semi-rigid conduit formed from a plastic or metal material and directly attached to a mounting block on the holster, wherein at least a portion of a length of the feed tube is disposed in the semi-rigid conduit for a continuous portion of its length.

2. The oral hydration system of claim 1, wherein the mounting fitting comprises:

a mounting plate;

a rotatable member attached to the mounting plate and configured to mate with a corresponding aperture in the holster; and a retention member attached to the rotatable member.

3. The oral hydration system of claim 1, wherein the mounting fitting comprises:

a mounting plate;

a non-rotatable peg attached to the mounting plate and configured to mate with a corresponding aperture disposed in the holster; and a retention member attached to the non-rotatable peg.

4. The oral hydration system of claim 1, further including a fluid-volume scale disposed on the holster.

5. The oral hydration system of claim 1, further including a fluid-volume scale disposed on the hydration liquid bladder.

6. The oral hydration system of claim 1, wherein the holster is configured to be mounted to the mounting structure by at least one strap.

7. The oral hydration system of claim 1, wherein the holster is configured to be mounted to the mounting structure by at least one clip.

8. The oral hydration system of claim 1, wherein the holster is formed from a plastic material.

9. The oral hydration system of claim 1 wherein the holster is formed from a molded plastic material.

* * * * *